US008287145B2

(12) United States Patent
Isogai et al.

(10) Patent No.: US 8,287,145 B2
(45) Date of Patent: Oct. 16, 2012

(54) LAMP

(75) Inventors: Toshiaki Isogai, Osaka (JP); Yasuhisa Ueda, Osaka (JP); Kazushige Sugita, Hyogo (JP); Hideo Nagai, Osaka (JP); Takaari Uemoto, Osaka (JP); Masahiro Miki, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/393,176

(22) PCT Filed: Sep. 6, 2011

(86) PCT No.: PCT/JP2011/004991

§ 371 (c)(1),
(2), (4) Date: Feb. 28, 2012

(87) PCT Pub. No.: WO2012/049805

PCT Pub. Date: Apr. 19, 2012

(65) Prior Publication Data

US 2012/0206933 A1 Aug. 16, 2012

(30) Foreign Application Priority Data

Oct. 12, 2010 (JP) ..... 2010-229856

(51) Int. Cl.
*F21V 23/00* (2006.01)

(52) U.S. Cl. ..... 362/222; 362/221; 362/223; 362/555; 362/249.02

(58) Field of Classification Search ..... 362/551, 362/555, 217.01, 221, 222, 223, 224, 363, 362/249.01, 249.02, 249.06, 249.14, 610, 362/630–632

See application file for complete search history.

(56) References Cited

U.S. PATENT DOCUMENTS

| | | | | |
|---|---|---|---|---|
| 7,699,490 | B2 * | 4/2010 | Tsai et al. | 362/154 |
| 7,972,053 | B2 * | 7/2011 | Hatti et al. | 362/628 |
| 7,976,206 | B2 * | 7/2011 | Wu et al. | 362/555 |
| 8,201,983 | B2 * | 6/2012 | Wang et al. | 362/602 |
| 2006/0006784 | A1 * | 1/2006 | Takahara et al. | 313/490 |
| 2006/0227558 | A1 | 10/2006 | Osawa et al. | |
| 2010/0237761 | A1 | 9/2010 | Osawa et al. | |
| 2010/0237779 | A1 | 9/2010 | Osawa et al. | |
| 2010/0244650 | A1 | 9/2010 | Osawa et al. | |

(Continued)

FOREIGN PATENT DOCUMENTS

| | | |
|---|---|---|
| JP | 2003-151305 | 5/2003 |

(Continued)

*Primary Examiner* — Thomas Sember

(57) ABSTRACT

A lamp 1 includes a semiconductor light-emitting element 12 as a light source, a circuit unit 40 that causes the semiconductor light-emitting element 12 to emit light, and an envelope 2 having an outer tube 30 and a base 60. The semiconductor light-emitting element 12 and the circuit unit 40 are housed in the envelope 2. The semiconductor light-emitting element 12 is disposed in a region at a side of an axially central section of the outer tube 30 facing the base 60 and oriented so that a main emission direction points away from the base 60. At least one component of the circuit unit 40 is disposed in a region at a side of the axially central section of the outer tube opposite the semiconductor light-emitting element 12. A light guide 50 that guides emission light of the semiconductor light-emitting element 12 along the axial direction is disposed between the at least one component of the circuit unit 40 and the semiconductor light-emitting element 12. The light guide 50 has a light-diffusing portion corresponding in position to the axially central section of the outer tube 30.

9 Claims, 7 Drawing Sheets

U.S. PATENT DOCUMENTS

| | | | |
|---|---|---|---|
| 2010/0244694 | A1 | 9/2010 | Osawa et al. |
| 2010/0253200 | A1 | 10/2010 | Osawa et al. |
| 2011/0156569 | A1 | 6/2011 | Osawa |
| 2011/0309386 | A1 | 12/2011 | Osawa et al. |
| 2011/0310606 | A1 | 12/2011 | Osawa et al. |

FOREIGN PATENT DOCUMENTS

| | | |
|---|---|---|
| JP | 2006-313717 | 11/2006 |
| JP | 2010-198807 | 9/2010 |

* cited by examiner

LAMP

TECHNICAL FIELD

The present invention generally relates to lamps having a semiconductor light-emitting element, such as a light-emitting diode (LED), as a light source. In particular, the present invention relates to an LED lamp having a base and a built-in circuit unit.

BACKGROUND ART

With the commercialization of high-intensity LEDs, recent years have seen the widespread use of LED lamps having an LED module as a light source. As one example, Patent Literature 1 discloses an LED lamp as a replacement for an incandescent lamp. The LED lamp disclosed has an LED module as a light source and a circuit unit for causing the LED module to emit light. The LED module and the circuit unit are housed in an envelope generally composed of a globe and a base. The circuit unit is disposed between the LED module and the base so as not to obstruct light emitted by the LED module.

CITATION LIST

[Patent Literature]

[Patent Literature 1]

Japanese Patent Application Publication No. 2006-313717

SUMMARY OF INVENTION

Technical Problem

Unfortunately, the above-described arrangement of the circuit unit naturally means that the circuit unit is located on the path of heat conduction from the LED module to the base, which involves the risk of thermally damaging electronic components and thus leads to reduction of lamp life.

In particular, to use an LED lamp in place of an HID lamp having higher intensity than incandescent lamps, it is necessary to use a larger number of LEDs or place a larger current to achieve a comparable level of intensity. In such a case, the amount of heat generated by the LED modules naturally increases, which makes the risk of thermally damaging electronic components more serious.

In addition, the following needs to be noted. That is, HID lamps have light distribution characteristics similar to those of a point light source and are configured to emit light mainly from an axially central section of the outer tube. By simply employing a configuration according to which light exits from the entire globe (corresponding to the outer tube of an HID lamp) as in the case of the LED lamp disclosed in Patent Literature 1, the resulting lamp fails to achieve light distribution characteristics similar to those of HID lamps.

The above description is directed to LED lamps as replacement for HID lamps. Yet, LED lamps may also be used as replacements for incandescent lamps. In such a case, it is still preferable to have the light distribution characteristics similar to a point light source at an axially central section of the globe. Since incandescent lamps have filaments generally at a central location of the globe, it is not preferable to process, for example, the inner surface of the globe to impart the light-diffusing properties to make the entire globe appear to emit light. Such an LED lamp is not a suitable replacement for an incandescent lamp.

The present invention is made in view of the problems noted above and aims to provide a lamp involving little risk of thermally damaging electronic components of the circuit unit and configured to emit light mainly from the axially central section of the outer tube.

Solution to Problem

In order to solve the problems noted above, a lamp according to one aspect of the present invention includes a semiconductor light-emitting element as a light source, a circuit unit configured to cause the semiconductor light-emitting element to emit light, and an envelope having an outer tube and a base. The semiconductor light-emitting element and the circuit unit are housed in the envelope. The lamp includes: a light guide configured to guide emission light of the semiconductor light-emitting element along an axial direction of the outer tube. The semiconductor light-emitting element is disposed in a region at a side of an axially central section of the outer tube facing the base and oriented so that a main emission direction points away from the base. At least one component of the circuit unit is disposed in a region at a side of the axially central section of the outer tube opposite the semiconductor light-emitting element. The light guide is disposed between the at least one component of the circuit unit and the semiconductor light-emitting element and has a light-diffusing portion corresponding in position to the axially central section of the outer tube.

ADVANTAGEOUS EFFECTS OF INVENTION

In the lamp according to the above aspect of the present invention, the semiconductor light-emitting element is disposed inside the outer tube and in a region at a side of the axially central section of the outer tube facing the base. In addition, at least one component of the lighting unit is disposed in a region at a side of the axially central section opposite the semiconductor light-emitting element. Being disposed in the region at the side of the axially central section of the outer tube opposite the semiconductor light-emitting element, the at least one component of the circuit unit is not on the path heat conduction from the semiconductor light-emitting element to the base. Consequently, there is little risk of thermally damaging electronic components. Therefore, the lamp has a long life.

In addition, the semiconductor light-emitting element is oriented to have the main emission direction away from the base. The light guide that guides emission light of the semiconductor light-emitting element to a direction along the axial direction is disposed between the at least one component of the circuit unit and the semiconductor light-emitting element. A section of the light guide has been processed to impart light-diffusing properties and the section corresponds in position to the axially central section of the outer tube. Owing to the above structure, light emitted by the semiconductor light-emitting element is repeatedly reflected within the light guide to ultimately reach the section processed to impart light-diffusing properties (hereinafter, the section may also be referred to as "light-diffusing section"). Having reached the light-diffusing section, light exits from the lamp. In other words, since light exits from the axially central section of the outer tube, the axially central section is mainly where light shines.

DESCRIPTION OF EMBODIMENTS

The following describes lamps according to embodiments of the present invention, with reference to the drawings. Note that the specifics, such as materials and numeric values, mentioned in the embodiments are given merely by way of preferable examples and without limitation. Various modifications may be made without departing from the technical concept of the present invention. Furthermore, one or more structural components of different embodiments may be combined unless a contradiction arises.

In addition, although an LED is specifically mentioned as a semiconductor light-emitting element, other semiconductor light-emitting elements are duly usable. Non-limiting examples of a usable semiconductor light-emitting element include a laser diode (LD) and an electroluminescence (EL) element.

<Embodiment 1>

[General Structure]

Figure 1:
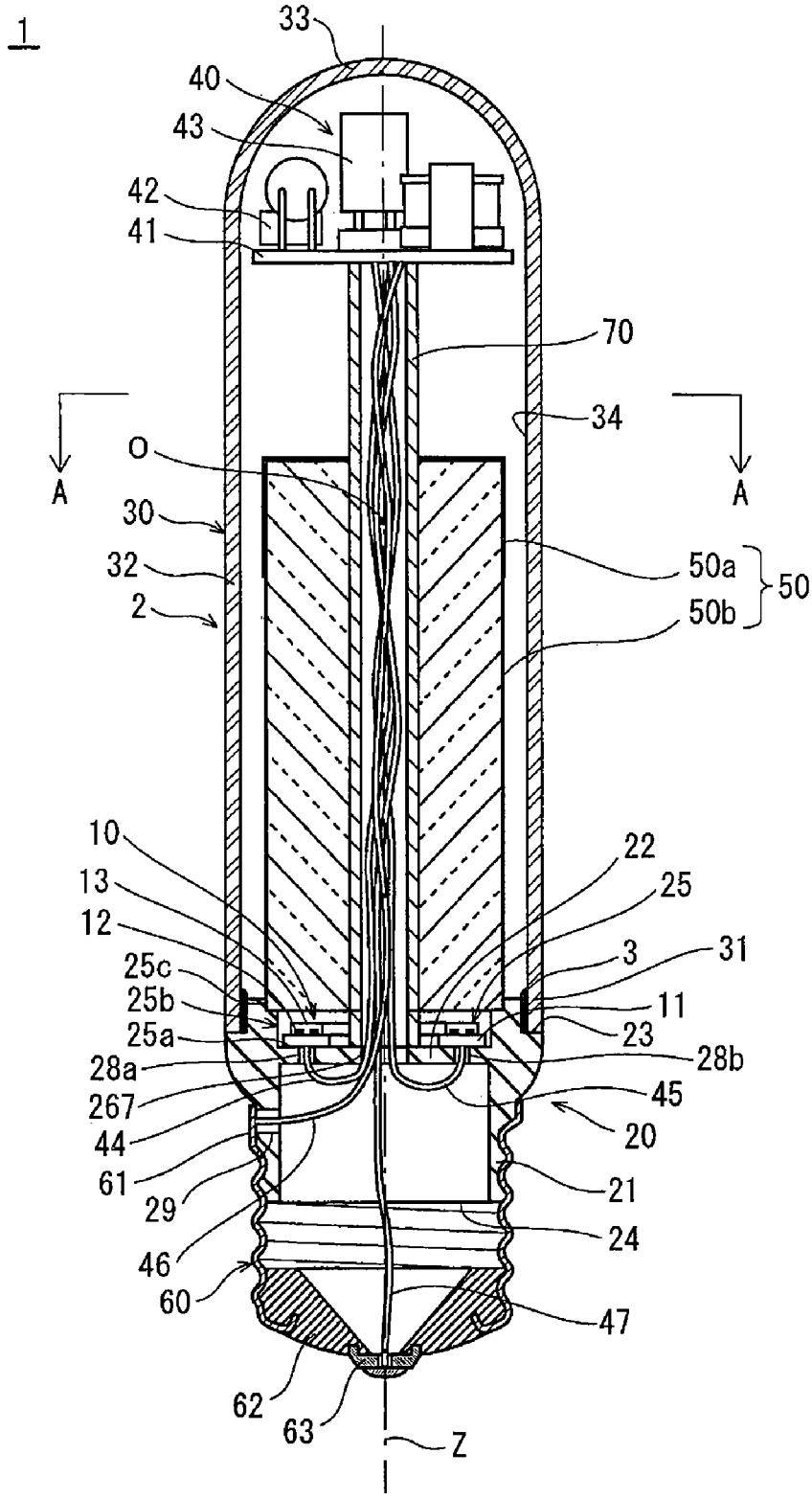
FIG. 1 is a cross-sectional view showing a structure of an LED lamp according to Embodiment 1.
Figure 2:
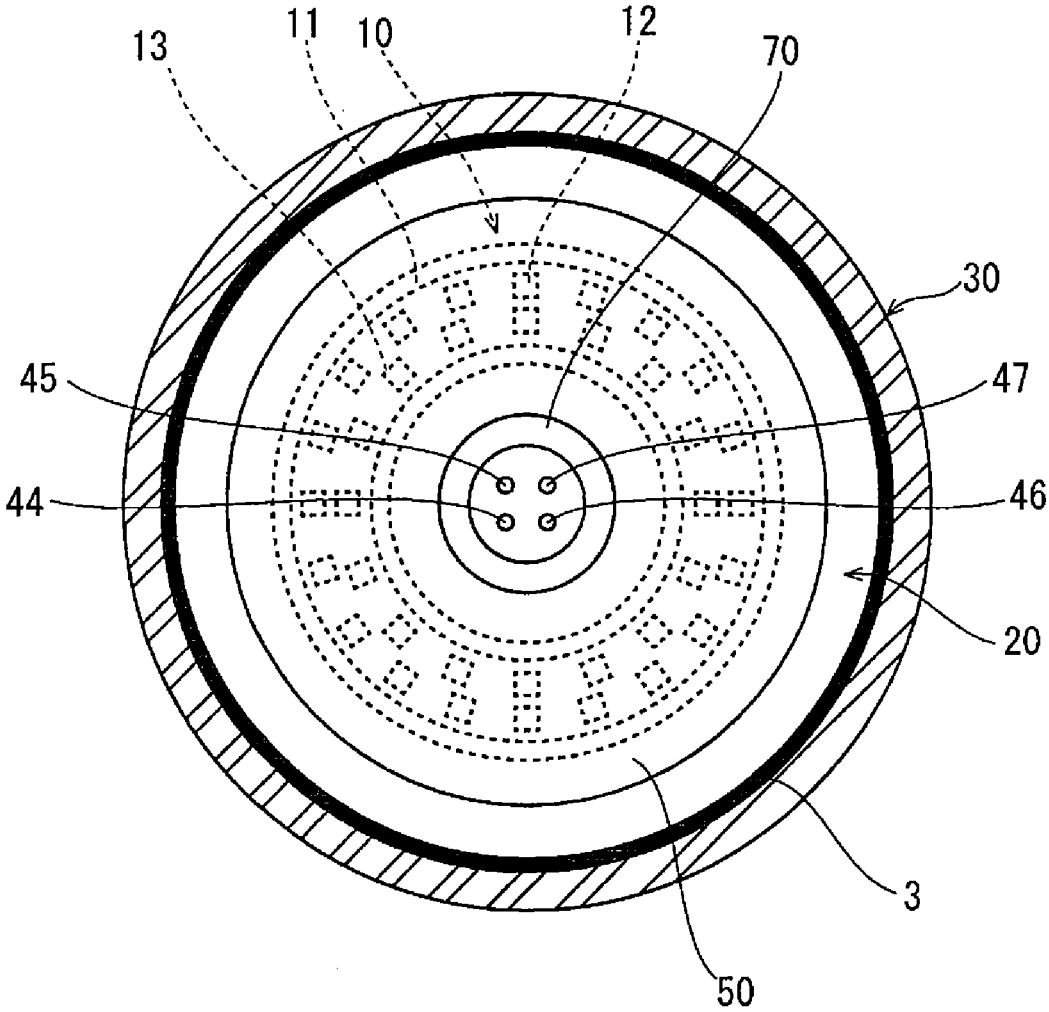
FIG. 2 is a cross-sectional view taken along line A-A in FIG. 1, looking in the direction of the appended arrows.

FIG. 1 is a longitudinal cross-sectional view showing the structure of an LED lamp according to Embodiment 1. FIG. 2 is a cross-sectional view taken along line A-A in FIG. 1, looking in the direction of the appended arrows.

As shown in FIG. 1, the LED lamp (corresponding to "lamp" of the present invention) 1 according to Embodiment 1 is usable as a replacement for an HID lamp and includes: an LED module 10 as a light source; a mount 20 on which the LED module 10 is mounted; an outer tube 30 housing the LED module 10; a circuit unit 40 for causing the LED module 10 to emit light; a light guide 50 that guides light received from the LED module 10 in the direction of the axis of the outer tube 30; and a base 60 electrically connected to the circuit unit 40.

To put it into another way, the lamp 1 is configured such that the LED module 10 and the circuit unit 40 are housed in an envelope 2 composed of the mount 20, the outer tube 30, and the base 60. The LED module 10 is disposed in a region of the outer tube 30 at a side of the axially central region facing the base 60 (i.e., the LED module 10 is disposed between the axially central region and the base 60). In addition, the LED module 10 is oriented to have the main emission direction away from the base 60. The circuit unit 40 is disposed in a region of the outer tube 30 at a side of the axially central region opposite the LED module 10. The light guide 50 is disposed between the circuit unit 40 and the LED module 10. The light guide 50 has a section 50*a* processed to impart the light-diffusing properties and this light-diffusing section 50*a* corresponds in position to the axially central section of the outer tube 30.

[Respective Components]

(1) LED Module

The LED module 10 has a mounting substrate 11, a plurality of LEDs (for example, 36 LEDs) 12 that serve as a light source and that are mounted on the surface of the mounting substrate 11, and a sealant 13 that is disposed on the mounting substrate to encapsulate the LEDs 12. The sealer 13 is mainly composed of a translucent material. When it is required for the sealer 13 to convert emission light of the LEDs 12 into predetermined wavelengths, a wavelength converting material to that effect is mixed into the translucent material. A silicone resin may be used as the translucent material, and phosphor particles may be used as the wavelength converting material.

In this embodiment, the LEDs 12 emitting blue light is used with the sealer 13 made from a translucent material containing phosphor particles that covert blue light into yellow light. Consequently, part of light emitted by the LEDs 12 is converted by the sealer 13 into yellow light, so that the LED module 10 emits white light which is a combination of blue light that remains unconverted and yellow light that results from the wavelength conversion.

In this embodiment, in addition, the mounting substrate 11 is made of a printed circuit board having an annular shape. In one example, 36 LEDs are arranged in concentric circles on the mounting substrate 11 (see FIG. 2). For example, of the 36 LEDs, 16 LEDs are arranged on the inner circle, whereas 20 LEDs are arranged on the outer circle.

(2) Mount

The mount 20 has the shape of a bottomed tube. More specifically, the mount 20 is generally composed of a tubular member 21 having a circular cylindrical shape and a closure 22 having a circular plate shape and extending from one end of the tubular member 21 to constitute the bottom. The closed end of the tubular member 21 is located nearer to the circuit unit 40. In the outer circumferential surface along the end nearer to the circuit unit 20, the mount 20 has a circumferentially extending recess 23 for engagement with an open end portion 31 of the outer tube 30. The open end portion 31 is received by the recess 23 and is secured thereto by adhesive 3, so that the mount 20 is bonded to the outer tube 30. The base 60 is fitted over the other end of the mount 20 away from the circuit unit 40 to close off the end of the tubular member 21.

The closure 22 has a depressed portion 25 at a location centrally of the end thereof facing toward the circuit unit 40. The LED module 10 is mounted on the inner bottom surface 25*a* of the depressed portion 25 in such a position that the main emission direction is pointed to the direction opposite to the base 60. The LED module 10 is secured to the mount 20 by, for example, screws, adhesive, or engaging structure. Heat generated during the operation of the LEDs 12 is transferred through the mount 20 to the base 60 and then to a lighting fixture (not illustrated).

An inner circumferential wall 25*b* of the depressed portion 25 has a stepped portion 25*c*. The light guide 50, which will be detailed later, is secured to the mount 20 by bonding one end of the light guide 50 along the stepped portion 25*c* by adhesive. It should be noted that the way of securing the light guide 50 to the mount 20 is not limited to the one described above. The securing may be accomplished with screws or engaging structure.

(3) Outer Tube

The outer tube 30 has the shape of a bottomed tube. More specifically, the outer tube 30 is generally composed of a tubular portion 32 having a circular cylindrical shape and a top portion 33 having a hemispherical shape and extending from one end of the tubular member 21 to constitute the bottom. The shape (type) of the outer tube 30 is not particularly limited. In the present embodiment, the outer tube 30 is of a straight-type similar to an outer tube of a straight-tube type HID lamp. Note that the outer tube 30 is not limited to an outer tube having one open and one closed end. Alternatively, an outer tube having two open ends may be used.

In the present embodiment, the outer tube 30 is colorless transparent and made of a translucent material, such as glass, ceramics, or resin. Light incident on the inner surface 34 of the outer tube 30 exits to the outside by passing through the outer tube 30 without being scattered. Note that the outer tube 30 is not necessarily colorless transparent and may alternatively be colored transparent.

(4) Circuit Unit

The circuit unit 40 includes a disc-shaped circuit substrate 41 and electronic components 42 and 43 mounted on the circuit substrate 41. The surface of the circuit substrate 41 on which the electronic components 42 and 43 are mounted faces away from the base 60. In the figures, only some of the electronic components are identified with reference signs. However, there are other electronic components not bearing reference signs.

The circuit unit 40 is supported by a support 70 and located within the top portion 33 of the outer tube 30. The circuit substrate 41 is bonded to one end of the support, so that the circuit substrate 41 is secured to the support 70. It should be noted that the way of securing the circuit unit 40 to the support 70 is not limited to the one described above. The securing may be accomplished with screws or engaging structure.

The circuit unit 40 is located within the top portion 33, which is at a remote end of the outer tube 30 from the LED module 10. This ensures to suppress conduction of heat from the LEDs 12 to the circuit unit 40, thereby reducing the risk of thermally damaging the electronic components 42 and 43 of the circuit unit 40.

Preferably, in addition, the electronic component 43, which is the tallest of all the electronic components constituting the circuit unit 40, is located centrally of the circuit substrate 41. With such an arrangement, the circuit unit 40 is housed inside the top portion of the outer tube 30 in a space saving manner and at a location farthest away from the LED module 10.

(5) Light Guide

The light guide 50 is made from, for example, acrylic resin and having a tubular shape (the shape of a hollow circular cylinder in this example) which is open at both ends. Note, however, the acrylic resin is not the only example, and any other translucent material may be used to form the light guide 50.

As the light guide 50 has the shape of a hollow circular cylinder, one of end surfaces (the end surface facing toward the LED module 10 (i.e., the entrance surface)) is annular in shape and conforms to the mounting area in which the LEDs 12 are annularly arranged. That is, the light guide 50 is disposed so that the entrance surface thereof faces the exit surfaces of the LEDs 12.

A section 50*a* of the light guide 50 has been processed to impart the light-diffusing properties, and the location of the light-diffusing section 50*a* corresponds to the axially central section of the outer tube. One example of such processing to impart the light-diffusing properties is frosting of the surface of the light guide 50. In addition, the light-diffusing section 50*a* may be manufactured from a translucent resin containing particulate or fibrous filler. A section 50*b* of the light guide 50 other than light-diffusing section 50*a* is provided with a reflecting film coating the inner surface thereof. The reflecting-film is formed, for example, of a deposition film of aluminum.

Due to the above structure, light entering into the light guide 50 from the end surface (entrance surface) is repeatedly reflected within the light guide to ultimately reach the light-diffusing section 50*a* where light exits from the lamp. That is, white light is radiated from the light-diffusing section 50*a*, and such distribution characteristics are similar to the light distribution characteristics of an HID lamp.

(6) Base

The base 60 is for receiving power supply from the socket of a lighting fixture when the lamp 1 is attached to the lighting fixture and operated. The base 60 is not limited to any specific type. In this embodiment, E26 Edison base is used. The base 60 is composed of a shell portion 61 and an eyelet portion 63. The shell portion 61 is tubular in shape and has an externally threaded circumferential surface, whereas the eyelet portion 63 is attached to the shell portion 61 via an insulating material 62.

(7) Support

The support 70 is a tubular member having the shape of a circular cylinder and made of glass, metal or resins, for example. One end of the support is fixed to the circuit unit 40 and the other end is inserted and bonded in a through hole 267 formed in the closure 22 of the mount 20.

More specifically, one end of the support 70 is secured to the circuit unit 40 by adhesive or the like, which results in that the support 70 is thermally connected to the circuit unit 40. In addition, the other end of the support 70 is bonded to the closure 22, which results in that the support 70 is thermally connected to the base 60 via the closure 22. This arrangement ensures heat released from the circuit unit 40 to be effectively transferred to the base 60 via the support 70.

As shown in FIGS. 1 and 2, the support 70 is inserted through the hollow of the light guide 50 having the shape of a hollow cylinder. Note that the support 70 is partly exposed from the light guide 50. The support 70 may be made of a transparent material, which further helps to avoid light emitted by the LEDs 12 being blocked by the support 70. Alternatively, the support 70 may be made of a material not transparent. In such a case, the outer surface of the support 70 may be processed to have a mirror finish to improve reflectivity. This arrangement helps to ensure that the support 70 does not absorb light emitted by the LEDs 12.

Instead of the shape of a circular cylinder, the support 70 may be a tubular member of any other shape such as prismatic. In addition, each support 70 may be a solid cylinder or solid prism instead of a tubular (i.e., hollow) member. When the support 70 is solid, electrical wiring lines 44-47, which will be described later, may be wound around the support 70 or disposed to extend along the support 70.

An output terminal of the circuit unit 40 is electrically connected to an input terminal of the LED module 10 via the wiring lines 44 and 45. The wiring lines 44 and 45 extending from the circuit unit 40 pass though the interior passage of the support 70 to reach a location closer to the base 60 than the closure 22 of the mount 20 is. The wiring lines 44 and 45 are then turned back to respectively pass through holes 28*a* and 28*b* formed in the closure 22 and connected to the LED module 10.

An input terminal of the circuit unit 40 is electrically connected to the base 60 via the wiring lines 46 and 47. The wiring lines 46 and 47 extending from the circuit unit 40 also pass through the interior passage of the support 70 to reach a location closer to the base 60 than the closure 22 of the mount 20. The wiring line 46 further extends to pass through a through hole 29 formed in the tubular member 21 of the mount 20 and is connected to the shell portion 61 of the base 60. On the other hand, the wiring line 47 further extends through an open end 24 of the tubular member 21 facing toward the base 60 and is connected to the eyelet portion 63 of the base 60.

Note that the electrical wiring lines 44-47 used in this embodiment are insulated leads.

Alternatively to the support 70, the wiring lines 44-47 of a larger diameter may be used to support the circuit unit 40. In that case, the wiring lines 44-47 serve also as the supports, and thus the circuit unit 40 is secured to the wiring lines 44-47.

[Positional Relation between LED Module 10 and Light Guide 50]

As shown in FIG. 2, the LED module 10 is located directly below the light guide 50 in plan view of the lamp 1 (i.e., when the lamp 1 is seen from the direction opposite to the base 60 along the lamp axis Z, i.e., when the lamp 1 is seen from the top to the bottom in FIG. 2). Thus, the LED module 10 is completely hidden below the light guide 50. Consequently, substantially entire light emitted by the LED module 10 in the main emission direction (in the directly upward direction in FIG. 2) is received by the light guide 50.

[Axially Central Section]

Figure 3:
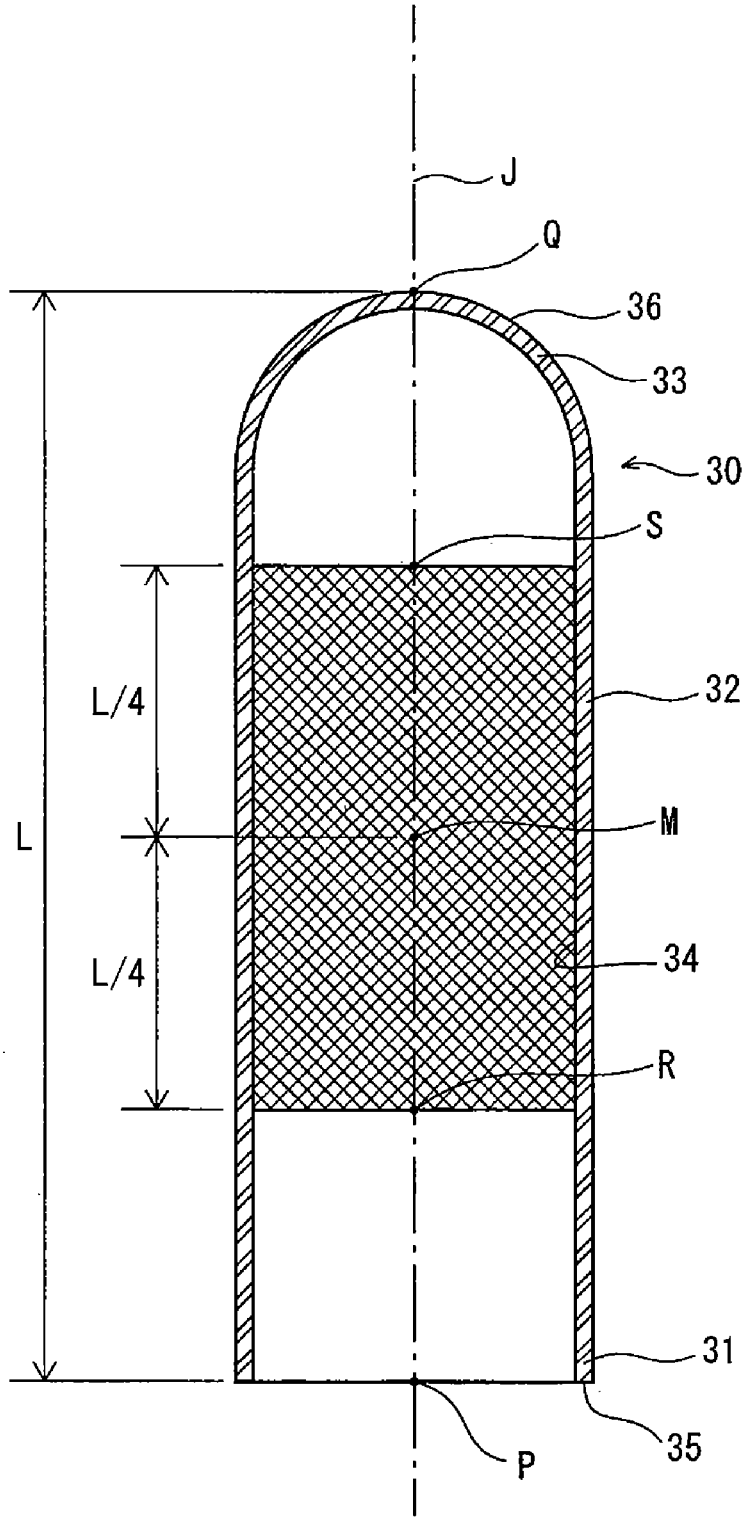
FIG. 3 is a view illustrating the axial center of an outer tube and an axially central section of the outer tube.

FIG. 3 is a view illustrating the axial center and the axially central section of the outer tube. The light guide 50 is disposed in the axially central section of the outer tube 30 in a manner that the center O (see FIG. 1) of the light-diffusing section 50*a* which therefore is the optical center of the lamp 1 coincides with the center M (see FIG. 3) of the outer tube 30. In this embodiment, the lamp axis Z coincides with the tube axis J of the outer tube 30.

Note that the center M of the outer tube 30 is a midpoint between Points P and Q, where P denotes an intersection point of the tube axis J of the outer tube 30 and the plane containing the open end 35 of the outer tube 30, and Q denotes an intersection point of the tube axis J and the topmost point 36 of the top portion 33. In addition, the axially central section of the outer tube 30 refers to a section between Points R and S (crosshatched area in FIG. 3), where L denotes the length of the outer tube 30 (equal to the distance between Points P and Q), and then each of Points R and S is 25% of the distance L (i.e., L/4) away from the center M along the tube axis J toward Points P and Q, respectively.

Note that the center O of the light-diffusing section 50*a* is not required to coincide with the center M of the outer tube 30. Yet, the positional relation should preferably satisfy the condition that at least the center O of the light-diffusing section 50*a* is located within the axially central section of the outer tube 30, and more preferably satisfy the condition that the light-diffusing section 50*a* is located entirely within the axially central section of the outer tube 30.

With the arrangement of the light-diffusing section 50*a* within the outer tube 30 to satisfy the above positional relation, the resulting lamp achieves to emit light from the axially central section of the outer tube in a manner similar to an HID lamp.

[Heat Dissipation Path]

Owing to the structure described above, the lamp 1 according to the present embodiment makes it possible to employ a larger number of LEDs 12 or a higher electric current. When a larger number of LEDs 12 is employed or a higher electric current is supplied to the LEDs 12, the amount of heat generated by the LED module 10 increases and the heat is transferred to the lighting fixture through the base 60. In the present embodiment, however, the circuit unit 40 is not located between the LED module 10 and the base 60, so that the distance between the LED module 10 and the base 60 may be configured to be shorter to allow more heat to be transferred from the LED module 10 to the base 60.

Note, in addition, that some heat generated by the LEDs 12 may remain within the LED module 10 and mount 20 without being transferred to the base 20, which causes the temperature of the LED module 10 and the mount 20 to elevate. Even so, heat load imposed on the circuit unit 40 is ultimately small, since the circuit unit 40 is housed in the outer tube 30 at a location opposite to the LED module 10 across the base 60.

As described above, the lamp 1 according to the present invention is configured so that heat load imposed on the circuit unit 40 does not increase even if the temperature of the LED module 10 and the mount 20 elevates. Therefore, it is not necessary to provide heat dissipating means, such as a heat sink, for lowering the temperature of the LED module 10 and mount 20, which is advantageous for preventing upsizing of the lamp 1.

In addition, by housing the circuit unit 40 in the outer tube 30, it is no longer necessary to secure space for accommodating the circuit unit 40 between the LED module 10 and the base 60. Consequently, the mount 20 of a smaller size may be usable. The mount 20 on which the LED module 10 is mounted undergoes a temperature rise. However, since the circuit unit 40 is not located between the LED module 10 and the base 60, it is not required to intentionally reduce the temperature of the mount LED module 10 and the mount 20.

[Other]

According to the present embodiment, since the circuit unit 40 is housed inside the outer tube 30, no space needs to be secured for accommodating the circuit unit 40 between the mount 20 and the base 60. Therefore, the mount 20 of a smaller size may be used, which is advantageous to configure the lamp 1 into the shape and dimensions similar to HID lamps. The above advantages help to improve the percentage of the lamps 1 according to the present embodiment to be fit to conventional lighting fixtures. In addition, with the use of the mount 20 of a smaller size, the outer tube 30 of a larger size can be used so that sufficient space for housing the circuit unit 40 can be made available inside the outer tube 30.

<Embodiment 2>

Figure 4:
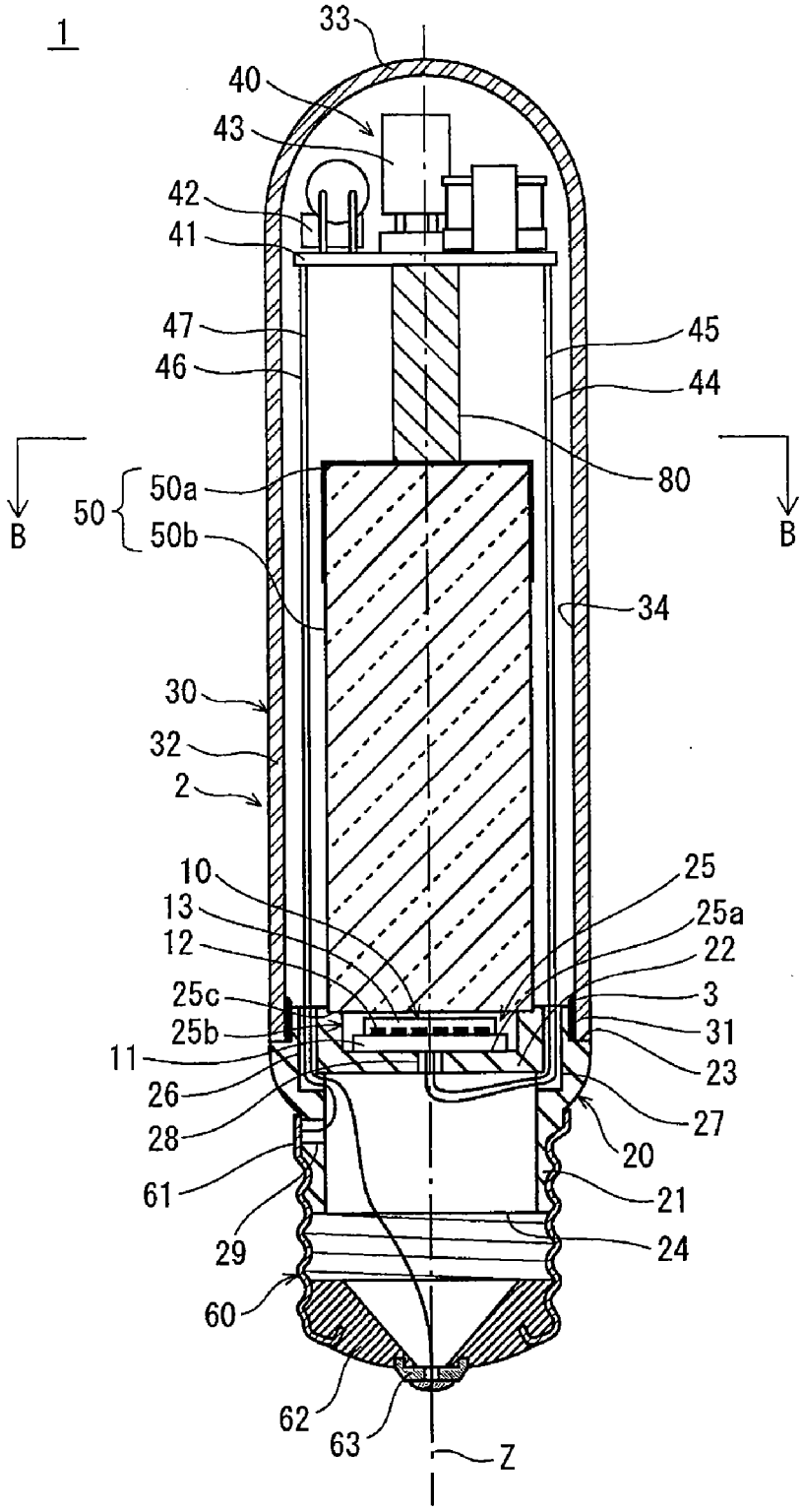
FIG. 4 is a cross-sectional view showing a structure of an LED lamp according to Embodiment 2.
Figure 5:
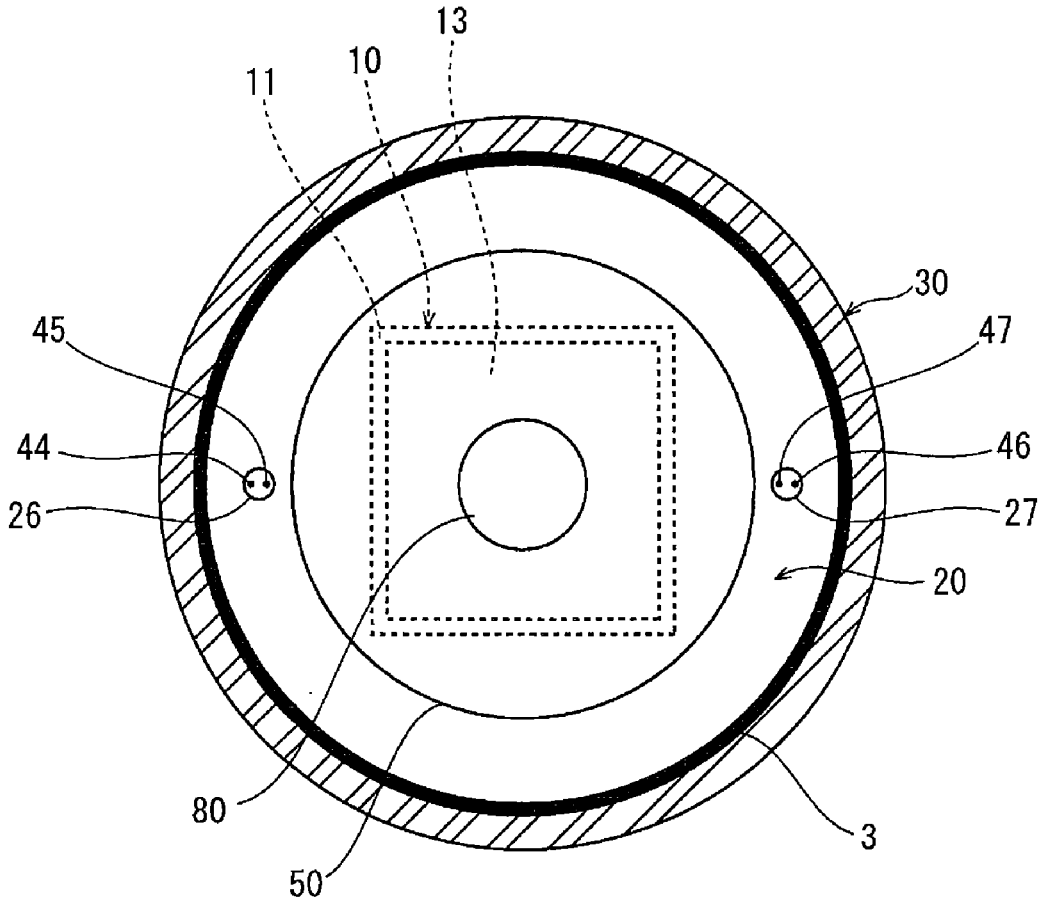
FIG. 5 is a cross-sectional view taken along line B-B in FIG. 4, looking in the direction of the appended arrows.

FIG. 4 is a cross-sectional view of an LED lamp 1 according to Embodiment 2. FIG. 5 is a cross-sectional view taken along line B-B in FIG. 4, looking in the direction of the appended arrows. The LED lamp 1 according to this embodiment has basically the same structure as that of the LED lamp 1 according to Embodiment 1, except mainly for the LED module 10, the light guide 50, and a pair of support 70 used. Therefore, of the components shown in FIG. 4, no description is given of those identical to the components of the LED lamp 1 according to Embodiment 1, while the following mainly describes the different components.

(1) LED Module

An LED module 10 according to this embodiment differs from the LED module 10 of Embodiment 1 in that the mounting substrate 11 has a plate-like shape (see FIG. 5).

(2) Light Guide

Although the light guide 50 according to Embodiment 1 has the shape of a hollow circular cylinder, a light guide 50 according to Embodiment 2 has the shape of a solid cylinder (a solid circular cylinder in this example).

As described above, the mounting substrate 11 and the light guide 50 of this embodiment differ in shape from corresponding components of Embodiment 1. However, as shown in FIG. 5, in plan view of the lamp 1, the LED module 10 is still located immediately below the light guide 50 and thus completely hidden below the light guide 80. That is, as the light guide 50 has the shape of a solid circular cylinder, one of end faces conforming has a shape conforming to the mounting area in which the LEDs 12 are arranged two-dimensionally. Consequently, light emitted by the LED module 1 in the main emission direction (in the directly upward direction in FIG. 10) is received substantially entirely by the light guide 50.

(3) Support

Similarly to the support according to Embodiment 1, the supports 70 according to this embodiment are made of glass, metal or resins, for example. Yet, the supports 70 of this embodiment differ in that each support has the shape of a solid cylinder (solid circular cylinder, in this example).

In addition, one end of the support 70 is secured to the circuit unit 40, and the other end of the support 70 is mounted and secured on the light guide 50. In one specific example, the other end of the support 70 is bonded to the light guide 50 by adhesive.

However, the support 70 is located in the light emission direction. Therefore, it is preferable to that the support 70 be made of a transparent material to avoid light emitted by the LEDs 12 being blocked by the support 70. In another example, the outer surface of the support 70 may be processed to have a mirror finish to improve reflectivity. This arrangement helps to ensure that the support 70 does not absorb light emitted by the LEDs 12.

(4) Electrical Wiring Line

In this embodiment, the wiring lines 44 and 45 extending from the circuit unit 40 pass though a through hole 27 formed in the mount 20 to reach a location closer to the base 60 than the closure 22 of the mount 20 is. The wiring lines 44 and 45 further extend to pass through a through hole 28 formed in the closure 22 and is connected to the LED module 10.

On the other hand, the wiring lines 46 and 47 extending from the circuit unit 40 pass through a through hole 26 formed in the mount 20 to reach a location closer to the base 60 than the closure 22 of the mount 20 is.

Similarly to Embodiment 1, this modification also achieves a lamp having light distribution characteristics similar to an HID lamp, while realizing the reduction of heat load imposed on the circuit unit 40.

<Modification 2-1>

The following describes a modification according to which the circuit unit is supported in a different manner.

Figure 6:
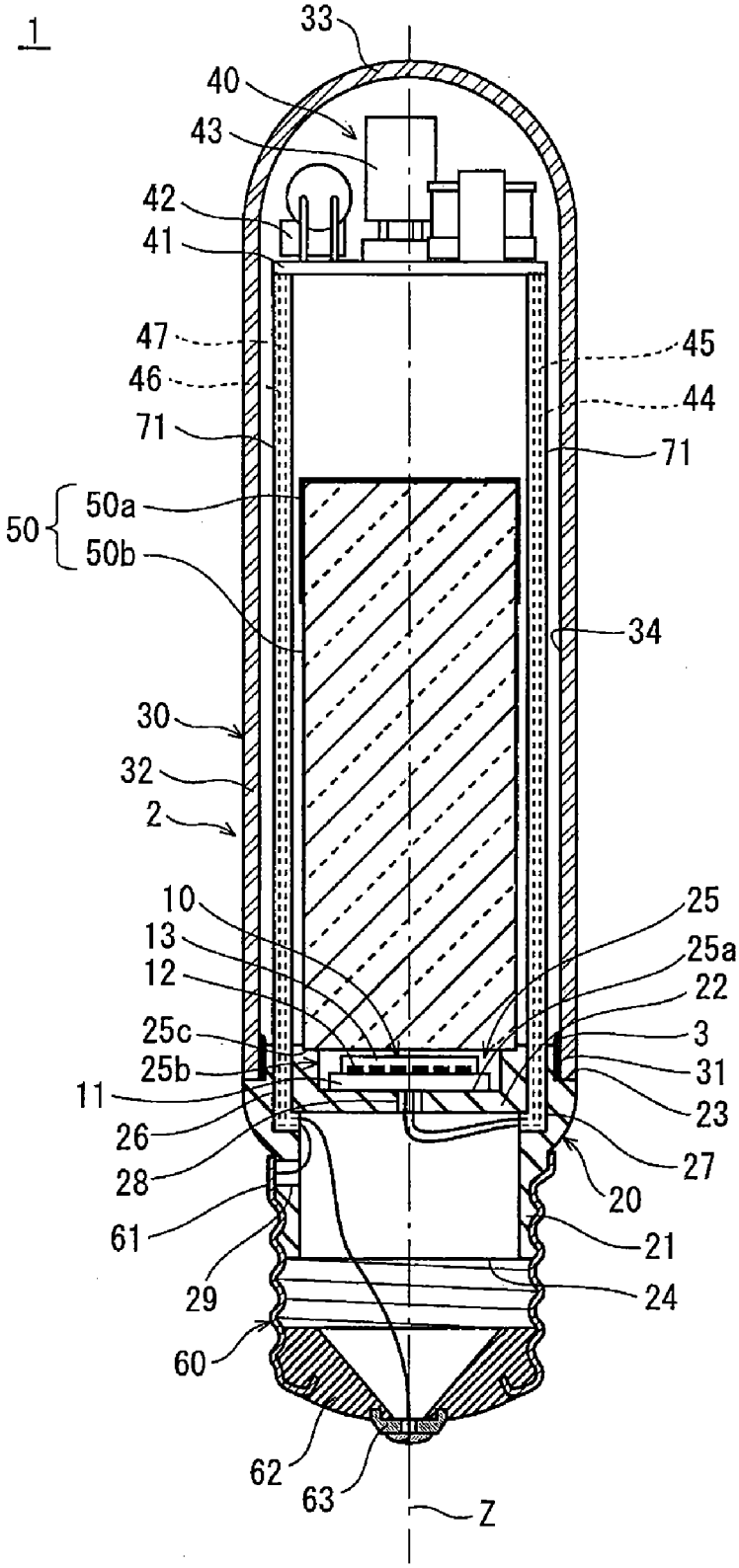
FIG. 6 is a cross-sectional view showing a structure of an LED lamp according to Modification 2-1.

FIG. 6 is a cross-sectional view showing a structure of an LED lamp according to Modification 2-1. The difference with the LED lamp 1 shown in FIG. 4 lies in the support 70. More specifically, in the lamp shown in FIG. 4, the support 70 is secured at one end to the light guide 50. In this embodiment, the lamp is provided with a pair of supports each of which is fixed at one end to the mount 20.

Each support 70 is a tubular member having the shape of a circular cylinder and made of glass, metal or resins, for example. One end of each support is fixed to the circuit unit 40 and the other end is inserted and bonded in a corresponding one of the through holes 26 and 27 formed in the closure 22 of the mount 20.

The supports 70 are disposed to face each other across the LED module 10 with the lamp axis Z in the middle. This arrangement helps to ensure that that the supports 70 do not block light emitted from the LED module 10 and that the circuit unit 40 is supported in balance. Note, in addition, that the number of supports 70 is not limited to two, and only one support or three or more supports may be used.

The wiring lines 44 and 45 extending from the circuit unit 40 pass though the interior passage of one of the supports 70 to reach a location closer to the base 60 than the closure 22 of the mount 20 is. The wiring lines 44 and 45 are then turned back to pass through a through hole 28 formed in the closure 22 and connected to the LED module 10.

The wiring lines 46 and 47 extending from the circuit unit 40 pass through the interior passage of the other one of the supports 70 to reach a location closer to the base 60 than the closure 22 of the mount 20 is.

This modification also achieves a lamp having light distribution characteristics similar to an HID lamp, while realizing the reduction of heat load imposed on the circuit unit 40.

<Embodiment 3>

Figure 7:
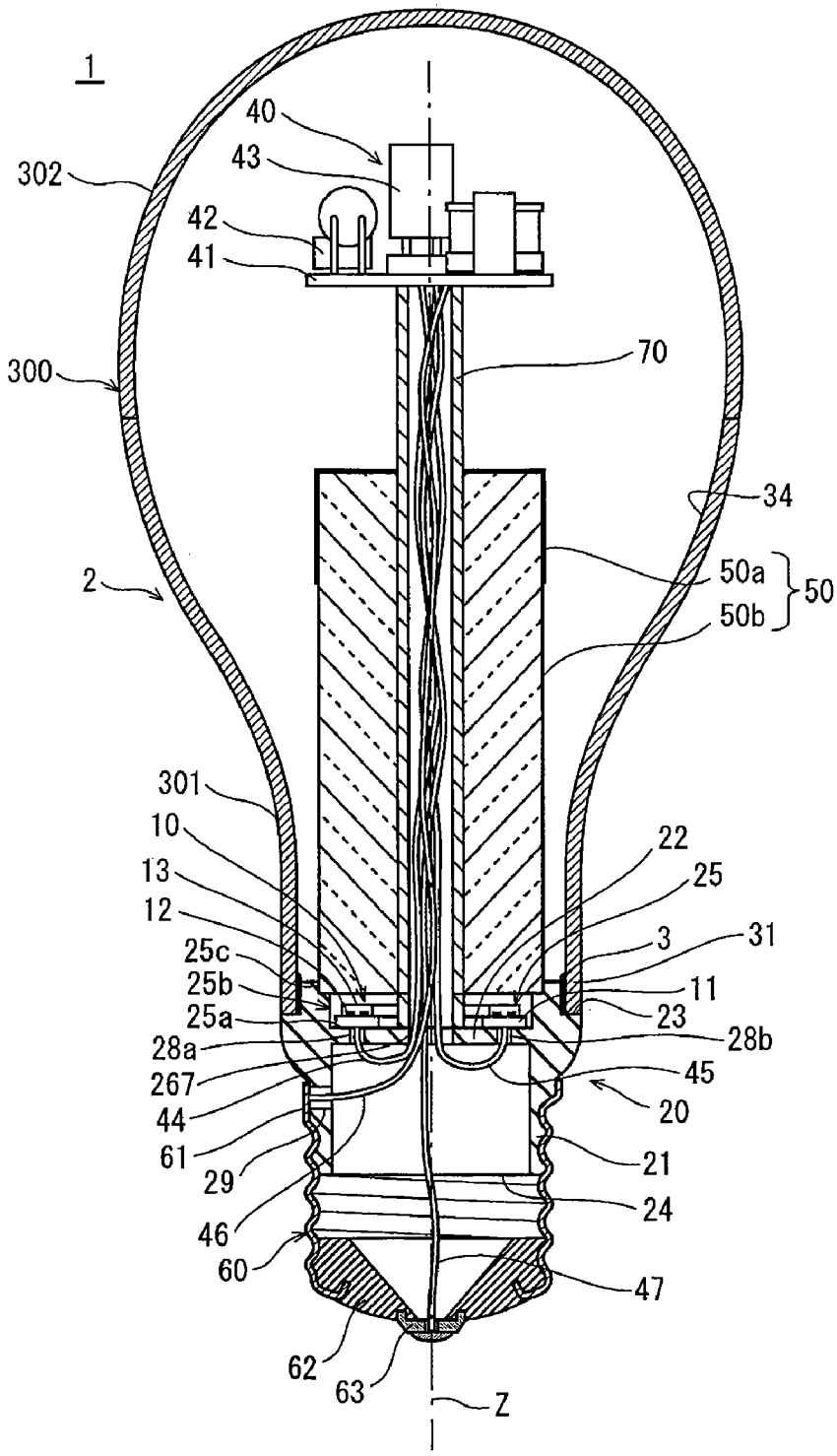
FIG. 7 is a cross-sectional view showing a structure of an LED lamp according to Embodiment 3.

FIG. 7 is a cross-sectional view of an LED lamp according to Embodiment 3. The LED lamp according to this embodiment is a bulb-type LED lamp. Except for having a globe instead of an outer tube, the LED lamp according to this embodiment is basically similar in structure to the LED lamp 1 according to Embodiment 1. Therefore, similarly to the other embodiment and modifications, the LED lamp according to this embodiment is provided with a light guide 50 having a light-diffusing section 50*a* at a location corresponding to a central section of a globe 300 in the direction of lamp axis Z.

Therefore, of the components shown in FIG. 7, no description is given of those identical to the components of the LED lamp 1 according to Embodiment 1, while the following mainly describes the different components.

As shown in FIG. 7, the globe 300 is of A-Type having a shape similar to a typical incandescent lamp. The globe 300 is composed of a tubular portion 301 that is diametrically larger from the base end toward the open end, and a hemispherical portion 302 closing the open end of the tubular portion 301. Note, however, that the shape (type) of the globe 300 is not specifically limited.

Since the circuit unit 40 is located within the hemispherical portion 302 of the globe 300, heat is not easily conducted from the LEDs 12 to the circuit unit 40. Consequently, the risk of thermally damaging the electronic components 42 and 43 of the circuit unit 40 is reduced.

As described above, the lamp having the globe 300 also achieves the reduction of heat load imposed on the circuit unit 40 since the circuit unit 40 is disposed at a location opposite the LED module 10 from the light guide 50, which also holds true with respect to Embodiment 1. In addition, the light guide 50 has a section 50*a* processed to impart the light-diffusing properties and this light-diffusing section 50*a* corresponds to the central section of the globe 300 along the lamp axis Z. By the presence of the light-diffusing section 50*a*, light emitted by the LED module 10 and guided by the light guide 50 in the direction of the lamp axis Z is radiated from the light-diffusing section 50*a*. In this way, the light distribution characteristics similar to a point light source is realized at the axially central section of the globe 300, the LED lamp according to this modification is even more suitable as a replacement for an incandescent lamp.

<Supplemental>

Up to this point, the LED lamp according to the present invention has been described by way of the above embodiments and modifications. It is naturally appreciated, however, that the present invention is not limited to those described above.

1. Base

According to the above embodiments and modifications, the base and mount are hollow bodies. However, the internal space may be filled with an insulating material having a higher conductivity than air. This modification helps heat generated by the LED module during the operation to be conducted to the lighting fixture via the base and the socket. This improves the total heat dissipation of the lamp. One example of the insulating material is a silicone resin.

2. LED Module (1) Mounting Substrate

Existing mounting substrates, such as a resin substrate, a ceramic substrate, a metal-based substrate composed of a resin plate and a metal plate, or the like may be used as the mounting substrate.

(2) LED

According to the above embodiments and modifications, blue LEDs are used. Alternatively, however, LEDs that emit light of another color may be used. In one example, the LEDs mounted on the LED module 10 may be ultraviolet LEDs. In that case, the sealer should be made of a translucent material containing phosphor particles of R, G, and B.

In addition, the LED module (LED lamp) described above employs only one type of LEDs to produce white light. Alternatively, three types of LEDs, namely LEDs emitting blue light, LEDs emitting red light, and LEDs emitting green light, may be employed to produce white light by combining emission light of the respective colors.

(3) Sealer

The sealer is described as covering all the LEDs mounted on the mounting substrate. However, a single LED may be covered with a single piece of sealer, or the LEDs may be grouped and a predetermined number of LEDs may be covered with a single piece of sealer.

3. Support

According to the above embodiments and modifications, the support and the light guide are provided as separate components. Alternatively, however, part of the light guide may be modified to additionally function as the support. For example, a light guide of a columnar shape may be provided with a projection that projects from the end surface facing toward the circuit unit and in a shape similar to the support shown in FIG. 4. The circuit unit 40 is supported by the projection. With this modification, the need to provide a separate support is eliminated, which leads to reduction of the number of components required.

4. Circuit Unit

According to the above embodiments and modifications, the circuit unit has a plurality of electronic components mounted on a single circuit substrate and the entire circuit unit is disposed at a location opposite the LED module 10 with respect to the axially central section. However, one or more components of the circuit unit may be disposed at a different location. For example, the circuit unit may have two circuit substrates and the electronic components are mounted separately on the two circuit substrates. One of the circuit substrates and the electronic components mounted thereon may be disposed at a location opposite the LED module 10 with respect to the axially central section, whereas the other circuit substrate and the electronic components mounted thereon are disposed at a different location. This modification eliminates the need to dispose all the electronic components within the outer tube. For example, electronic components relatively resistant to heat may be disposed at a location between the LED module and the base. With the above modification, the circuit unit to be housed in the outer tube can be minimized by the volume of the electronic components disposed at a location between the LED module and the remote end of the base from the LED module.

According to the above embodiments and modifications, the circuit substrate of the circuit unit is oriented so that the main surface thereof is orthogonal to the lamp axis Z. Alternatively, however, the circuit substrate may be oriented so that the main surface thereof is parallel to the lamp axis Z or inclined with respect to the lamp axis Z.

[Other]

In the above embodiments and modifications, the supports 70 function as heat dissipating means. Additionally to the supports 70, a heat pipe may be provided between the circuit unit and the base for transferring heat from the circuit unit to the base. For example, a rod-like heat pipe made of material having a high thermal conductivity may be disposed between the circuit unit and the base in manner that the heat pipe is thermally connected at one end to the circuit unit and to the base at the other end. In this modification, it is preferable to provide electrical isolation to ensure that no current flows between the circuit unit and the base via the heat pipe.

[Industrial Applicability]

The present invention is applicable for the miniaturization of LED lamps and the improvement in lamp intensity.

[Reference Signs List]

1 Lamp
2 Envelope
12 Semiconductor light-emitting element
20 Mount
30 Outer tube
40 Circuit unit
44-47 Electrical wiring line
50 Light Guide
60 Base

The invention claimed is:

1. A lamp including a semiconductor light-emitting element as a light source, a circuit unit configured to cause the semiconductor light-emitting element to emit light, and an envelope having an outer tube and a base, the semiconductor light-emitting element and the circuit unit being housed in the envelope, the lamp comprising:

a light guide configured to guide emission light of the semiconductor light-emitting element along an axial direction of the outer tube, wherein the semiconductor light-emitting element is disposed in a region at a side of an axially central section of the outer tube facing the base and oriented so that a main emission direction points away from the base, at least one component of the circuit unit is disposed in a region at a side of the axially central section of the outer tube opposite the semiconductor light-emitting element, and the light guide is disposed between the at least one component of the circuit unit and the semiconductor light-emitting element and has a light-diffusing section corresponding in position to the axially central section of the outer tube.

2. The lamp according to claim 1, wherein the light guide has an entrance portion for light emitted by the semiconductor light-emitting element to enter, the entrance portion facing an exit portion of the semiconductor light-emitting element.

3. The lamp according to claim 2, further comprising:

a mount disposed at an opening of the base, the semiconductor light-emitting element being disposed on the mount;

a tubular support attached at one end to the mount so as to support the at least one component of the circuit unit; and a pair of electrical wiring lines, one of which connects the semiconductor light-emitting element to the at least one component of the circuit unit and another of which connects the base to the at least one component of the circuit unit, the electrical wiring lines extending through an interior passage of the support.

4. The lamp according to claim 3, wherein the semiconductor light-emitting elements comprises a plurality of semiconductor light-emitting elements annually arranged, and the light guide is in a shape of a hollow tube having an end face to which the annually arranged semiconductor light-emitting elements faces, the end face comprising the entrance portion.

5. The lamp according to claim 4, wherein the support is disposed to pass through the hollow of the light guide.

6. The lamp according to claim 2, wherein the light guide has a columnar shape, and the lamp further comprising:

a support disposed on the light guide and supporting the at least one component of the circuit unit.

7. The lamp according to any claim 2, wherein the at least one component of the circuit is disposed in the region at the side of the axially central section opposite the semiconductor light-emitting element, and all other components of the circuit unit are disposed between the base and the semiconductor light-emitting element.

8. The lamp according to claim 1, wherein the light guide has a reflecting film coating an inner surface thereof, excluding the light-diffusing section.

9. The lamp according to claim 1, wherein the at least one component of the circuit is disposed in the region at the side of the axially central section opposite the semiconductor light-emitting element, and all other components of the circuit unit are disposed between the base and the semiconductor light-emitting element.

* * * * *